United States Patent [19]

Unger et al.

[11] Patent Number: 4,482,270

[45] Date of Patent: Nov. 13, 1984

[54] DRIVE SHIELDS FOR TUNNEL-DRIVING APPARATUS

[75] Inventors: Eberhart Unger, Lunen; Dieter Stuckmann, Selm; Jürgen Hein, Lunen, all of Fed. Rep. of Germany

[73] Assignee: Gewerkschaft Eisenhutte Westfalia, Lunen, Fed. Rep. of Germany

[21] Appl. No.: 469,603

[22] Filed: Feb. 24, 1983

[30] Foreign Application Priority Data

Feb. 25, 1982 [DE] Fed. Rep. of Germany ..... 3206717

[51] Int. Cl.[3] ..... E01G 3/02; E21D 19/00

[52] U.S. Cl. ..... 405/145; 405/138; 405/141

[58] Field of Search ..... 405/145, 141, 138, 272, 405/273, 284, 282, 283

[56] References Cited

U.S. PATENT DOCUMENTS

| | | | |
|---|---|---|---|
| 3,866,426 | 2/1975 | Lobbe | 405/145 X |
| 3,998,067 | 12/1976 | Fernandez | 405/145 |
| 4,112,696 | 9/1978 | Jutte et al. | 405/145 |
| 4,334,800 | 6/1982 | Stuckmann | 405/145 |
| 4,398,845 | 8/1983 | Stuckmann et al. | 405/145 |

*Primary Examiner*—Dennis L. Taylor

*Attorney, Agent, or Firm*—Sughrue, Mion, Zinn, Macpeak and Seas

[57] ABSTRACT

A drive shield for tunnel driving has a plurality of cutters supported for longitudinal displacement on a frame. The cutters are hollow and contain double-acting hydraulic rams used to displace the cutters and the frame. The rams are linked to the cutters via alignable connector shackles and detachable bolts. To connect the rams to the frame use is made of coupling pieces which have spigots engaging through shackles on the rams. The coupling pieces pass through slots in the cutters and are guided on the frame for displacement to release or mate the spigots with the shackles.

10 Claims, 5 Drawing Figures

DRIVE SHIELDS FOR TUNNEL-DRIVING APPARATUS

BACKGROUND TO THE INVENTION

The present invention relates in general to drive shields for use in tunnel-driving apparatus. More particularly, the invention is concerned with a drive shield composed of a plurality of elongate drive or cutter members arranged side-by-side and supported for displacement on a frame. Double-acting hydraulic rams serve selectively to advance the drive members and to draw up the frame.

Drive shield of the aforementioned kind are well known and are used for driving underground tunnels, adits galleries, roadways and the like. In such drive shields it is also known to construct the frame from two parts spaced apart along the tunnel. The rams are then positioned between the frame parts. It is however known from German published patent specifications 2622201 and 2849776, to construct the drive members as hollow components and to arrange the rams inside the drive members. The rams are thus held in a protected position and do not take up space within the shield. This arrangement permits the frame to be of moderate length. The rams are connected to the rear frame part with the aid of brackets.

In these known constructions the transmission of drive force to the rear frame part is problematic and it is difficult to gain access to the rams for replacement etc. in the restricted space available. There are also problems in attaching the so-called follow-up rear tails which extend the drive members in the rearward direction and enable a lining to be created behind the drive shield. Further difficulties can arise in the protection of the rams against the ingress of debris and dirt.

A general object of the present invention is to provide an improved drive shield construction.

SUMMARY OF THE INVENTION

A drive shield constructed in accordance with the invention comprises elongate drive or cutter members supported for displacement on frame means and double-acting hydraulic rams for effecting relative displacement between the drive members and the frame means. The drive members are hollow and the rams are disposed wholly within the drive members. In accordance with the invention the rams are detachably connected to the drive members and to the frame means, usually a rear frame part thereof, with connection means including connectors on the rams which receive displaceable components such as bolts, spigots or the like, which components can be introduced and withdrawn from the interior of the shield. The drive members can be provided with openings on the inside to permit access to the connectors on the rams. The connectors can take the form of open shackles or the like.

In one preferred construction, the displaceable components are spigots or journals which are provided on coupling pieces or brackets. These coupling pieces are then supported for displacement on the frame means and screws or other threaded elements can clamp the coupling pieces to the frame means. By loosening these screws the coupling pieces can be displaced to bring their spigots out of the connectors on the rams. T-shaped grooves on the frame means can guide the coupling means.

Each coupling piece can have a single spigot to engage in a connector of one ram and drive member. Alternatively each coupling piece can have two spigots to engage in two connectors on the rams of two adjacent drive members.

The coupling pieces engage through slots in inner wall of the drive members and are preferably tapered, e.g. in frusto-conical fashion, over the regions extending through the slots to resist the ingress of dirt into the drive members.

To aid the installation of the rams in the drive members from the rear the latter may have guides therein and stops to position the rams forwardly. Seals inside the drive members preferably engage on the rams to resist the ingress of material therein. The coupling pieces can move radially of the shield when their spigots are locating with or being withdrawn from the connectors on the rams.

The displaceable components may also comprise bolts or pins which engage through complementary connectors on the rams and in the drive members. These bolts can be inserted or withdrawn through openings in the inner wall of the drive members. Covers can close off these openings.

The invention may be understood more readily, and various other aspects and features of the invention may become apparent from consideration of the following description.

BRIEF DESCRIPTION OF DRAWINGS

Embodiments of the invention will now be described, by of way of examples only, with reference to the accompanying drawings, wherein.

DESCRIPTION OF PREFERRED EMBODIMENTS

Figure 1:
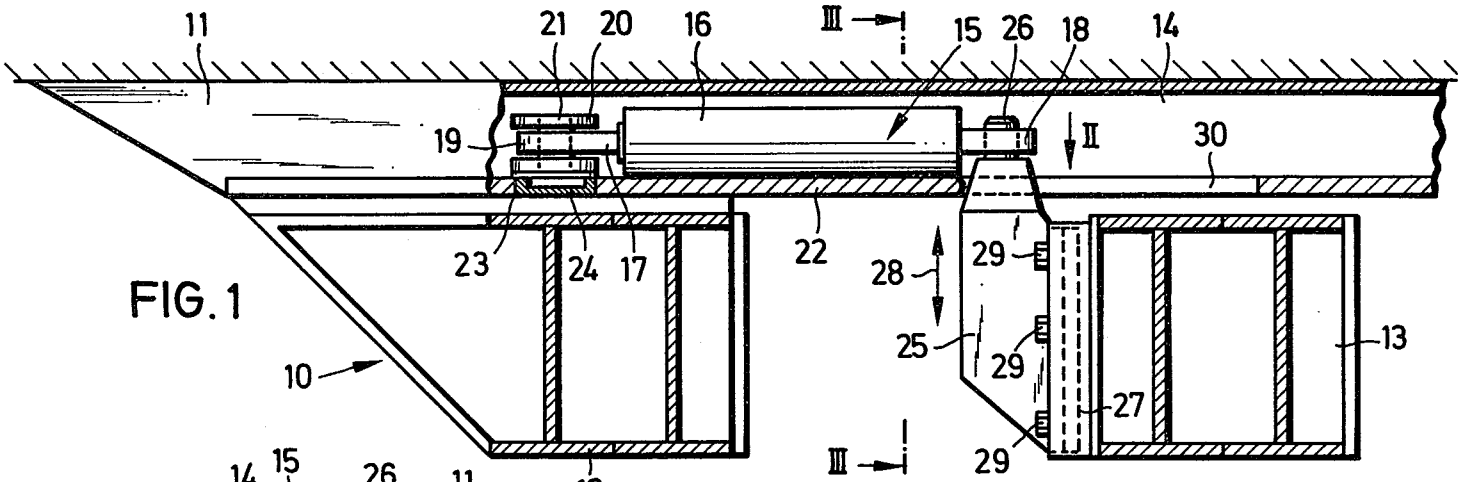
FIG. 1 is a diagrammatic part-sectional side view of part of the drive shield of apparatus constructed in accordance with the invention.
Figure 2:
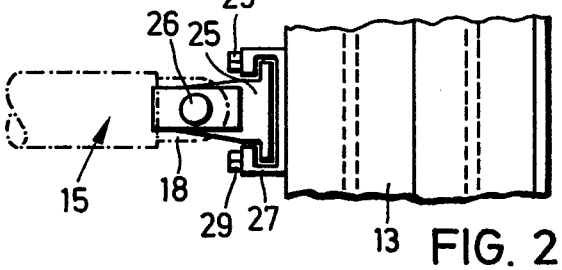
FIG. 2 is a plan view of part of the shield, the view being taken in the direction of arrow II in FIG. 1.

In general, tunnel-driving apparatus of the type with which the present invention is concerned employs a drive shield composed of a plurality of elongate drive members or cutters arranged side-by-side in a cylindrical array. The drive members are supported for longitudinal displacement on an inner frame and double-acting hydraulic rams, which are connected between the frame and the drive members, serve to advance the drive members individually or in groups and to draw up the frame when the drive members have all been advanced. The accompanying drawings mainly depict part of a single drive member in accordance with the invention together with associated components of the drive shield. Thus referring to FIG. 1, the drive member is designated 11 while the frame common to all the drive members 11 is designated 10. The drive member 11 is connected to the frame 10 for longitudinal guidance with the aid of T-shaped grooves and guide pieces, for example. The drive members 11 combine to form a near-continuous cylinder and FIG. 3 shows two drive members 11 adjacent to the central drive member 11 under consideration.

The frame 10 itself is composed of a front part 12 and a rear part 13 spaced rearwardly therefrom. The frame parts 12, 13 are interconnected by means of further components thereby to form a rigid structure.

Figure 3:
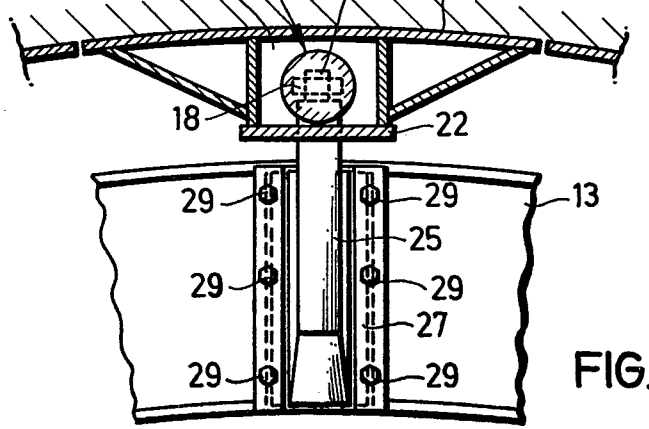
FIG. 3 is a sectional-end view taken along the line III—III of FIG. 1.

As shown in FIGS. 1 and 3, the drive members or cutters 11 are hollow with a box-like section. The interior 14 of each drive member 11 contains a double-acting hydraulic ram 15 which serves relatively to displace the frame 10 and the drive member 11. The ram 15 is connected to the frame 10 and the drive member 11 with the aid of detachable connection means as will now be described. The ram 15 is provided with connectors in the form of eyes or shackles 18,19 on its cylinder 16 and piston rod 17. As shown in FIG. 1, the piston rod 17 is located at the forward end of the ram 15 but this is illustrative and the rod 17 could be located at the rear of the ram 15. The drive member 11 has a complementary bi-furcated connector 20 which has bores which align with the connector 19 on the piston rod 17. A component in the form of a pin or bolt 21 is located through the connectors 20,19 to complete the connection means between the ram 15 and the drive member 11. To permit access to the pin 21 an opening 23 is provided in the inner wall 22 of the member 11. The opening 23 is closed by means of a removable cover 24 which is screwed, bolted or otherwise clamped in position. When the cover 24 is detached the displaceable pin 21 can be withdrawn or inserted. It is also possible to connect the cover 24 to the pin 21 or to form an integral unit constituting both the bolt 21 and the cover 24. The connector or eye 18 on the cylinder 16 receives a similarly displaceable component in the form of a journal or spigot portion 26 of a bracket or coupling piece 25 fitted to the rear frame part 13. The inner wall 22 of the drive member 11 is provided with a slot 30 through which extends the coupling piece 25. As shown, the coupling piece 25 tapers over the region engaged through the slot 30, e.g. in frusto-conical manner. This assists in preventing the ingress of material through the slot 30. The rear frame part 13 is provided with guides 27 which are formed with, e.g. T-shaped grooves. The guides 27 can be welded to an end face of the frame part 13. Each coupling piece 25 associated with one of the members 11, has a T-shaped edge received by the T-shaped groove of one of the guides 27 for displacement in the directions of the arrow 28, i.e. parallel to the axis of the spigot portion 26 and radially of the shield. Screws 29 are mounted on the front faces of the guides 27 to engage with the coupling piece 25 to clamp the latter.

Figure 4:
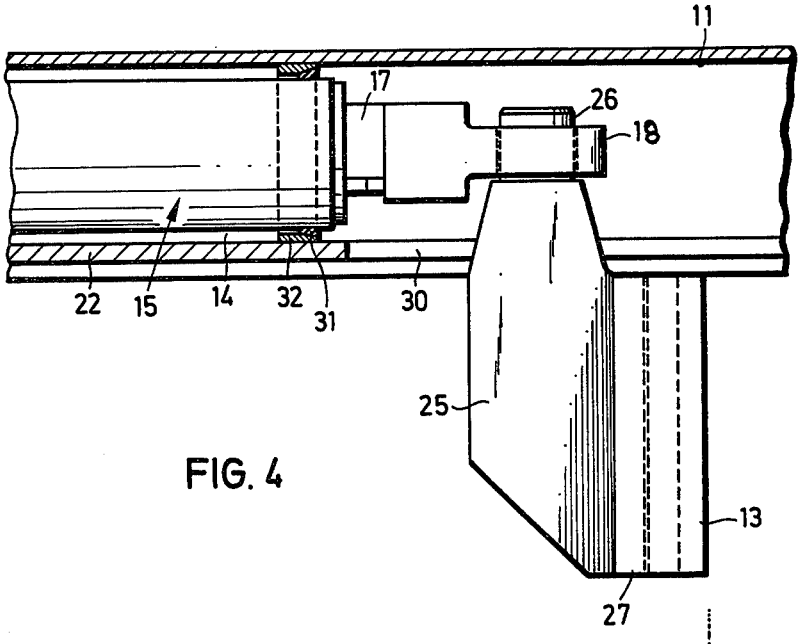
FIG. 4 is a diagrammatic part-sectional side view of the rear region of the shield part shown in FIG. 1 the view being taken on a somewhat larger scale to that adopted in FIG. 1.

FIG. 4 is an enlarged view of the rear connection 18,26. As shown in FIG. 4, a flexible seal 31 engages on the cylinder 16 to prevent dirt from passing into the interior 14 of the drive member 11. The seal 31 is carried by a retaining ring 32 fitted to the interior of the member 11.

During assembly, the ram 15 is introduced from the rear of the drive member 11 into its interior 14 through the seal 31. The ram 15 is then pushed forwardly so that the connector 19 on the piston rod 17 aligns with the connector 20. A stop can be provided in the drive member 11 to aid the location and alignment of the connectors 19,20. One or more additional guides can also be provided in the interior 14 slidably to engage and guide the cylinder 16. The bolt 21 can then be inserted through the connectors 19, 20. The installation of the ram 15 can take place with the drive member 11 remote from the frame 10 so that the latter does not hinder the installation process. Alternatively the drive member 11 can be positioned so that the frame 10 does not impede the location of the bolt 21. Once the ram 15 has been fitted to the drive member 11 the connector 18 on its cylinder 16 can receive the spigot portion 26 of the coupling piece 25. The coupling piece 25 is displaced along its guide 27 after release of the screws 29, to pass through the slot 30 and engage the spigot portion 26 in the connector 18. Once the connection is established the screws 29 are tightened to clamp the coupling piece 25 to the frame part 13. To disconnect or dismantle the drive members 11, the screws 29 are released and the coupling piece 25 is displaced along the guide 27 away from the drive member 11 to withdraw the spigot portion 26 from the connector 18 of the ram 15.

Various modifications can be made to the embodiments described. For example, instead of a T-shaped profile for the guides 27 and the coupling pieces 25 other shapes can be adopted. To prevent the coupling pieces 25 accidentally falling out of the guides 27, especially at the roof zone of the shield, at least one of the screws 29 can be made to pass through the shaped edges of each of the coupling pieces 25. Other measures can however be adopted to prevent the coupling pieces 25 becoming detached from the frame part 13.

Figure 5:
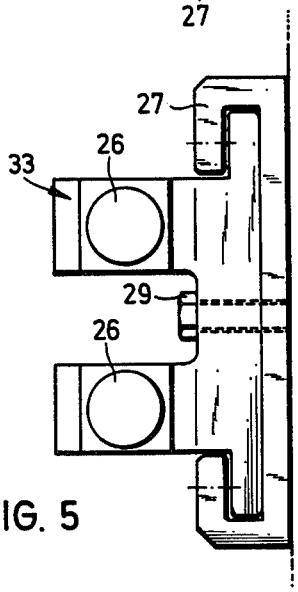
FIG. 5 is a plan view corresponding to FIG. 1 but depicting a modified arrangement.

FIG. 5 shows a modified type coupling piece 33. In this modified construction, the coupling piece 33 which locates with the guide 27 with a T-shaped profile as before, has two parallel spigot portions 26. Each spigot portion 26 locates with the connector 18 of an associated ram so that each coupling piece 33 serves to connect the rams 15 of a pair of drive members 11 to the frame part 13. The coupling piece 33 carries one or more screws 29 which clamp the coupling piece 33 to the guide 27 as before and prevent accidental detachment of the coupling piece 33.

We claim:

1. In a drive shield including a plurality of elongate hollow drive members (11) supported for longitudinal displacement on frame means (10), double-acting hydraulic rams (15) disposed within the drive members (11) for effecting relative displacement between the drive members and the frame means, and detachable connection means (19, 20, 21; 18, 25, 26) connecting the rams to the drive members and the frame means; the improvements comprising: the connection means including connectors (18) on the rams for receiving spigots (26) of coupling pieces (25), the coupling pieces being displaceable to introduce and withdraw the spigots from the connectors by radial movement relative to the interior of the shield, guides (27) provided on the frame means to locate the coupling pieces for such movement, and clamping means (29) for clamping the coupling pieces to the frame means to lock the coupling pieces in position with their spigots engaged in the connectors of the rams.

2. A drive shield according to claim 1, wherein the guides define T-shaped grooves.

3. A drive shield according to claim 1, wherein threaded elements serve as the clamping means to clamp the coupling pieces to the frame means.

4. A drive shield according to claim 1, wherein each coupling piece has two spigots which engage in the connectors of the rams of two adjacent drive members.

5. A drive shield according to claim 1, wherein the coupling pieces extend through slots in the drive members and the coupling pieces have tapered profiles over the regions extending through the slots.

6. A drive shield according to claim 1, wherein the connectors on the rams take the form of shackles.

7. A drive shield according to claim 1, wherein the detachable connection means further comprises bolts which locate through connectors on the rams and complementary connectors in the drive members, and the drive members have openings permitting the introduction and removal of the bolts by radial movement relative to the interior of the shield.

8. A drive shield according to claim 7, wherein the openings are closed off with detachable cover plates.

9. A drive shield according to claim 8, wherein the bolts are integral with the cover plates.

10. A drive shield according to claim 1, wherein the drive members have guides therein for aiding the installation of the rams therein and flexible seals on the inside of the drive members engage on the rams.

* * * * *